US006688288B1

(12) United States Patent
Houston et al.

(10) Patent No.: US 6,688,288 B1
(45) **Date of Patent: *Feb. 10, 2004**

(54) INTERNAL COMBUSTION ENGINES

(75) Inventors: Rodney Alexander Houston, Woodvale; David Shawcross, Heathridge; Martin Peter McNiff, Scarborough; Paul Thomas Gulvin, Booragoon, all of (AU)

(73) Assignee: Orbital Engine Company (Australia) PTY, Limited, Balcatta (AU)

( * ) Notice: This patent issued on a continued prosecution application filed under 37 CFR 1.53(d), and is subject to the twenty year patent term provisions of 35 U.S.C. 154(a)(2).

Subject to any disclaimer, the term of this patent is extended or adjusted under 35 U.S.C. 154(b) by 0 days.

(21) Appl. No.: 08/607,476

(22) Filed: Feb. 27, 1996

(30) Foreign Application Priority Data

Feb. 27, 1995 (AU) ..... PN 1399

(51) Int. Cl.[7] ..... F02M 37/04
(52) U.S. Cl. ..... 123/456; 123/469
(58) Field of Search ..... 123/456, 533, 123/179.17, 198 D, 184.21, 469; 114/270

(56) References Cited

U.S. PATENT DOCUMENTS 4,934,329 A * 6/1990 Lear ..... 123/456
4,941,854 A * 7/1990 Takahashi ..... 114/270
5,216,996 A * 6/1993 Kato ..... 123/533
5,309,885 A * 5/1994 Rawlings ..... 123/456
5,394,820 A * 3/1995 Dach ..... 114/270
5,513,614 A * 5/1996 Gras ..... 123/179.17
5,572,964 A * 11/1996 Cogneville ..... 123/179.17
5,593,330 A * 1/1997 Kobayashi ..... 440/84
5,598,827 A * 2/1997 Kato ..... 123/533
5,634,422 A * 6/1997 Kobayashi ..... 114/270
5,740,783 A * 4/1998 Learman et al. ..... 123/497
6,015,321 A 1/2000 Ozawa et al.
6,095,876 A 8/2000 Ozawa et al.
6,132,274 A 10/2000 Nanami
6,135,832 A 10/2000 Suzuki
6,200,178 B1 3/2001 Nakase et al.
6,213,825 B1 4/2001 Ozawa
6,238,258 B1 5/2001 Ozawa
6,244,915 B1 6/2001 Ozawa
6,250,980 B1 6/2001 Ozawa

* cited by examiner

*Primary Examiner*—Carl S. Miller
(74) *Attorney, Agent, or Firm*—Rothwell, Figg, Ernst & Manbeck, P.C.

(57) ABSTRACT

An internal combustion engine such as a multi-cylinder in-line engine having on one side of the cylinder head an air induction system and on the opposite side an exhaust system, each extend generally in the direction of the length of the engine. Each of said systems extending above the level of a cylinder head of the engine and a fuel rail is provided extending in the direction of the length of the engine and mounted on the cylinder head to be located between the air induction system and the exhaust system. The fuel rail overlies and is in fuel transfer communication with respective fuel injector units mounted in the head of each cylinder of the engine. Preferably, the fuel rail is configured so as to provide sufficient clearance on the exhaust side thereof to enable spark plugs to be appropriately arranged within the cylinder head on the exhaust side thereof. The fuel injector units may be of the type wherein the fuel is entrained in a compressed gas for delivery to the engine and the fuel rail includes both a passage for the conveyance of fuel and a further passage for the conveyance of the gas, normally air.

37 Claims, 3 Drawing Sheets

INTERNAL COMBUSTION ENGINES

This invention relates to engines and engine propelled vehicles and particularly to relatively small multi-cylinder engines such as those commonly used in personal watercraft such as jet skis and jet boats. It is envisaged that the invention is equally applicable to other "personal-type" small engined vehicles such as snow-mobiles and small all-terrain vehicles.

As a result of the increasing concern in regard to air pollution by exhaust gases from internal combustion engines, legislation is beginning to be introduced or made more stringent in some countries relating to the level of emissions contained in exhaust gases from the engines of a range of relatively small vehicles. This is in addition to the existing legislation relating to the emissions from cars and trucks and like large vehicles.

Further, having regard to the size and weight of the engine of small vehicles, it is important to design such engines so as to occupy the smallest possible space within the vehicle and, as a consequence, reduce the overall size and weight of the vehicle. At the same time, such engines must be able to develop a relatively high power output in order to obtain a level of performance acceptable to the purchasing public.

In order to achieve relatively high power outputs together with low exhaust emissions, it has in some cases been necessary to avoid the use of the more conventional carburettor or manifold injected engines and to adopt a direct injected engine in order to achieve these desired high power outputs and low exhaust emissions. However, such engines typically require additional componentry which can result in an increase in the space requirement of the engine within the vehicle and thus it is important to obtain an engine layout which is relatively compact.

It is therefore the object of the present invention to provide an engine particularly suitable for use in small vehicles including personal watercraft which is of minimum physical dimensions and an acceptable manufacturing cost.

With this object in view there is provided, according to one aspect of the invention, an in-line multi-cylinder internal combustion engine having on one side of the cylinder block an air induction system and on the opposite side an exhaust system, each extending generally in the direction of the length of the engine and both said systems extending beyond the plane of a cylinder head of the engine, a fuel rail extending in the direction of the length of the engine and mounted on the cylinder head to be located between the air induction system and said exhaust system, said fuel rail overlying and being in fuel transfer communication with respective fuel injection units located in the cylinder head, and each said fuel injector communicating with a respective cylinder of the engine.

Preferably, a spark plug is mounted in each cylinder to enter the cylinder at a level below the top of the fuel rail and to project from the cylinder head to one side of the fuel rail. The spark plugs may be arranged in the cylinder head at a location between the engine exhaust system and the fuel rail. Conveniently, the fuel rail is configured so as to provide sufficient clearance on the exhaust system side thereof, when mounted on the cylinder head, to enable the spark plugs to be appropriately arranged within the cylinder head on the exhaust system side thereof. Alternatively, for different engine configurations, the fuel rail may be configured to allow for appropriate location of the spark plugs on the air inlet side of the engine.

Preferably, the fuel injector units are of the type wherein the fuel is entrained in a compressed gas for delivery to the engine, and the fuel rail includes both a passage for the conveyance of fuel and a further passage for the conveyance of the gas, normally air. Preferably, the fuel rail also has incorporated thereon a fuel pressure regulator and a gas pressure regulator. These regulators are conveniently mounted on the fuel rail on the side thereof remote from the spark plugs. More particularly, the regulators are arranged on the fuel rail at a location immediately adjacent the air induction system.

Conveniently, the fuel rail is configured such that when mounted on the cylinder head, the regulators mounted thereon are located adjacent the air induction system such that sufficient clearance is provided on the exhaust side of the cylinder head for the spark plugs to be arranged therein. In this regard, the air induction system may be able to be slightly angled so as to enable the appropriate location of the fuel rail on the cylinder head. Alternatively, for an alternative location of the spark plugs, the exhaust system may be able to be slightly angled for similar reasons.

Preferably, the fuel rail is arranged such that an air inlet thereto is located at an opposite side to a fuel inlet thereto. Conveniently, the air and fuel inlets are arranged at opposing ends of the length of the rail with the air inlet being located adjacent that end of the engine where a drive-shaft projects from the cylinder block. It is however to be noted that other arrangements for the location of the fuel and air inlets on the rail are possible such as, both at the same end on the length thereof. Preferably, the fuel inlet is arranged to correspond with that end of the engine adjacent which a fuel pump is located.

Preferably, the air induction system is configured to comprise one air flow control means for regulating the amount of air to each of the cylinders of the engine. Whilst it is possible to provide an individual air flow control means for each cylinder of the engine, each housed in an individual air conduit of the air induction system as is well known, for example, personal watercraft engines, the provision of a single air flow control means enables significant simplification of the air induction system. This in turn reduces the component cost thereof as well as contributing to a reduced overall size, weight and complexity of the engine.

Where the engine is of the type incorporating a fuel injector unit which delivers the fuel entrained in a gas to a combustion chamber of the respective cylinders, it is also necessary to provide an on-board source of compressed gas, typically air, for this purpose. The preferred source of compressed air is typically from an engine driven compressor. Conveniently, the compressor is driven by the engine via a portion of the engine crankshaft the projects from one end of the engine via a pulley or gear mounted thereon or on the drive-shaft coupled thereto, or by an appropriately provided surface of a coupling between the crankshaft and drive-shaft of the compressor. Accordingly, it is preferable to locate such a compressor on the engine such that it corresponds to an end of the engine wherein it is possible to conveniently couple the drive-shaft of the compressor to the engine crankshaft or a drive-shaft connected thereto. Some engines may have a camshaft to effect operation of the valves of the engine, and/or a balance shaft and the compressor may be suitably coupled to the camshaft or balance shaft to be driven thereby.

In an engine constructed so that a portion of the exhaust system projects beyond the upper extremity of the engine block at the end where the drive-shaft is located, and is adjacent an upper end of the engine block or the cylinder head thereof, it is preferable for the compressor to be mounted below the level of that portion of the exhaust system so that the compressor does not increase the overall size or length of the engine. Further, it is appropriate for the delivery port of the compressor to be located in the upper portion of the compressor when mounted so that the length of the conduit carrying the air to the fuel rail is minimised. That is, it is preferable to mount the compressor at that end of the engine which corresponds to the end where the drive-shaft thereof is located and also so as to correspond with the air inlet of the fuel rail. In this way, the length of the air line connecting the compressor delivery port and the air inlet to the rail is kept to a minimum.

This feature provides the advantage that the volume of the conduit to carry the air between the compressor delivery port and the nozzles of the fuel injector units, which is required to be pressurised prior to satisfactory operation of the fuel system, is kept to a minimum. Hence, whether this volume is "pumped up" by way of cylinder pressure during engine cranking such as is disclosed in the applicant's U.S. Pat. No. 4,936,279 which is incorporated herein by reference, or whether "pump up" of this air volume occurs simply due to the first few cycles of the compressor, this desired location and arrangement of the compressor substantially reduces the overall "pump up" or pressurisation time of this air volume.

As previously described, for packaging reasons, the compressor may conveniently be arranged to lie beneath a portion of the exhaust system of the engine. That is, the compressor may conveniently be mounted adjacent the exhaust system to take advantage of any cavities or unused space created thereby so as to not contribute to an increase in the overall length, width or depth of the engine. It should however be noted that the compressor may similarly be mounted on the intake side of the engine and that similarly, such mounting may take advantage of any cavity created by the orientation and shape of the air induction system. Still further, the compressor may alternatively be located centrally of the drive-shaft end of the engine such that it is directly coupled thereto or directly driven thereof.

It should be noted that the feature of locating the compressor adjacent the exhaust system or induction system such that it does not contribute to an increase in the overall engine packaging size, and of locating the compressor to correspond with the drive-shaft end of the engine, is not limited to engines requiring a fuel rail to be mounted between the air induction and exhaust systems. Whilst such an arrangement of the compressor is particularly relevant to engines which do have a fuel rail mounted as such and which require a source of pressurised gas for operation, the arrangement is equally applicable to other configurations of fuel systems which may require a source of pressurised gas for operation.

Preferably, a fuel tank and fuel pump of the engine are located adjacent the end of the engine opposite to the location of the compressor with a fuel delivery line therefrom being connected to the adjacent end of the fuel rail. A fuel return line communicates the fuel pressure regulator thereon with the fuel tank. Preferably, the fuel pump is located within or immediately adjacent the fuel tank so that there is a minimum delay in delivery of fuel to the engine on initial start-up of the fuel pump. That is, the overall length of the fuel lines between the fuel tank and the fuel pump and also the length of the fuel lines between the fuel pump and the inlet to the fuel rail are kept to a minimum such that the priming time of these lines is minimal. In particular, the fuel pump suction line from the fuel tank is desired to be as short as possible so as to enable the fuel pump to supply fuel at a high pressure after as short a time as possible once the fuel pump begins operating.

As previously stated, it is convenient to locate the fuel pump such that the pump delivery aligns with the fuel inlet of the fuel rail. This obviously serves to minimise the length of the fuel line connecting these two components. This further contributes to a much neater and cheaper package due to the elimination of unnecessarily long fuel lines.

The location of the fuel pump adjacent or within the fuel tank also reduces the accumulation of fuel vapour in the fuel pump suction line prior to start up. This location also serves to keep the fuel pump away from the hot environment on or directly adjacent the engine such that satisfactory operation thereby is not compromised. A further benefit may also ensue from locating the fuel pump within the fuel tank in that the fuel tank and the fuel therein, within which the fuel pump operates, will operate as a sound insulator. That is, the noise generated by the fuel pump during operation, so far as the rider is concerned, will typically be reduced.

It should be noted that whilst the feature of locating the fuel pump adjacent or within the fuel tank is particularly applicable to the arrangement described wherein a fuel rail is disposed between the exhaust and air induction systems of an engine, the feature is equally applicable to other engine arrangements for personal watercraft and small engined vehicles which simply require a source of high pressure fuel for operation.

The fuel priming advantages as mentioned above are particularly important in respect of engine installations in personal watercraft such as "jet skis" which typically incorporate an engine cut-out that is activated if a rider is dislodged from or falls off the water craft. However, it is also important for the engine to be quickly started once the rider re-mounts and cancels the cut-out. The need for a quick start arises from the limited stability of some water craft, such as the jet ski when not being driven by the engine. These are important safety features in that the water craft is not left to operate without a driver aboard with the potential to injury other people in the water. Also the dislodged driver can be at risk of injury by the watercraft from which has been dislodged.

In one example the engine cut-out is connected to the driver by a lanyard so that if the driver is dislodged from the craft the separation of the driver from the craft cause the lanyard to activate the engine cut-out and hence stop the water craft. The cut-out of the engine can be achieved by interruption of either fuel and/or electrical energy to the engine to thereby terminate operation of the engine of the craft. The quicker response is achieved by interruption of the electrical energy supply.

Advantageously, in accordance with another aspect of the invention, the fuel system is activated on insertion of the lanyard cut-out. Thus the fuel supply is activated in advance of commencement of the cranking of the engine thus providing a more rapid engine start-up when cranked.

In alternative forms of the invention, following engine shut-down the fuel system may be activated prior to starting of the engine by any means indicating that the engine is about to be started. For example, a sensor may be provided which senses whether an operator is positioned in the driver's seat of a vehicle. If so, the fuel system is activated, thus priming the fuel lines in preparation for engine start-up. Other indicators that the vehicle is about to be started may include movement of brake/accelerator/clutch devices, opening of a vehicle door, and insertion of a key into the vehicle ignition device.

The early activation of the fuel pump will result in the fuel pump being cycled for a short period of time to prime the fuel lines to the fuel rail prior to the rider activating the engine starter. As is well known, and common to most personal watercraft such as jet skis, one end of the lanyard is worn by the rider such that if the rider is dislodged from the jet ski, the other end of the lanyard will be disconnected from the jet ski and typically cause the engine to cut-out. Hence, by cycling the fuel pump as soon as the rider re-connects the lanyard, the fuel system is pre-primed such that upon activating the engine starter, the engine operation is established more quickly.

The invention will now be described with reference to the accompanying drawings in which there is illustrated one practical arrangement of an engine installation and layout incorporated in a jet ski.

Figure 1:
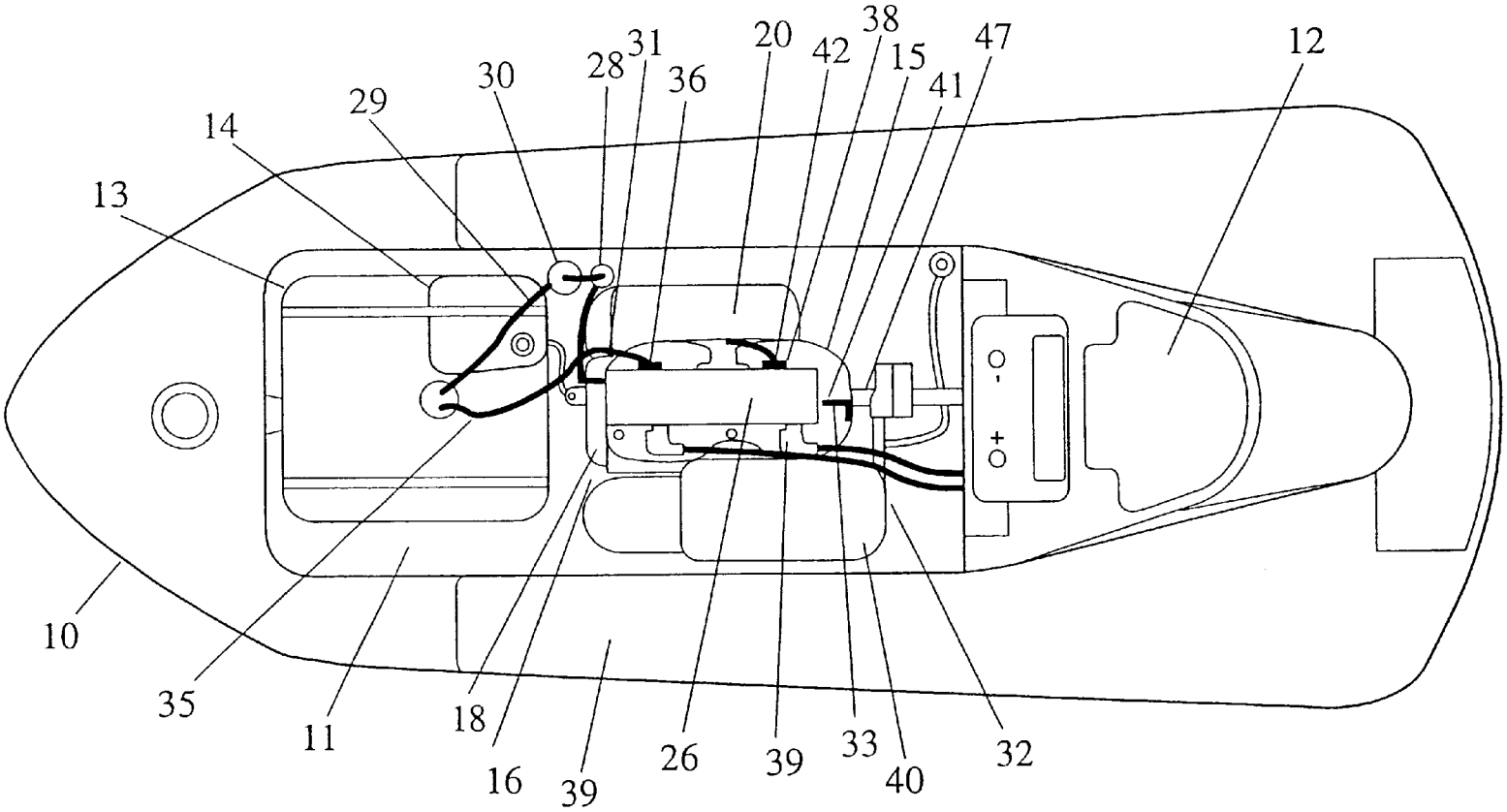
FIG. 1 is a diagrammatic plan view of an engine installation in a jet ski.

Referring now to the drawings, the hull 10 of the jet ski has an engine and fuel tank cavity 11 provided therein forwardly of a rear portion of the rider's seat 12. A fuel tank 13 is located in the cavity 11 at the forward end of the craft and has incorporated therein an oil tank 14 that provides oil to an oil pump 18 mounted on a block 16 of the engine 15.

Figure 2:
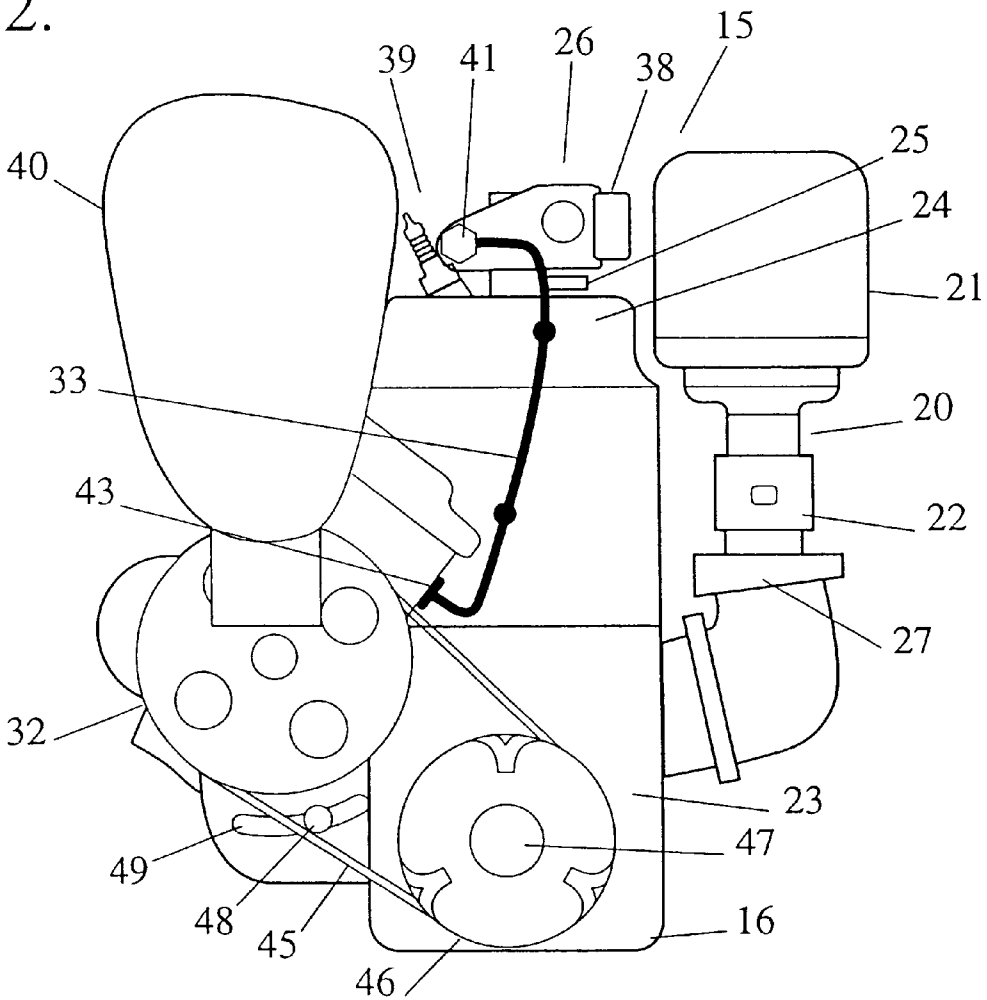
FIG. 2 is an elevation of the engine assembly of the jet ski shown in FIG. 1 when view from the rear of the jet ski.

The two cylinder engine 15 is positioned immediately rearward of the fuel tank 13, and is of a two cylinder construction with the cylinders arranged in a side by side relation in the longitudinal direction of the hull 10. The engine 15 operates on the conventional two stroke cycle principle and incorporates direct injection of the fuel into the respective cylinders, thereby eliminating the conventional air induction system incorporating a carburettor or single point fuel injection system. The air induction system 20 as best seen in FIG. 2, has an air box 21 which projects above the level of the engine cylinders and extends for a greater part of the longitudinal length of the engine 15. The air induction system 20 comprises a single air conduit incorporating a single butterfly type valve assembly 22 to control the rate of air supply to the engine 15. The valve 22 is controlled directly by driver demand such as by way of the known cable operated throttle or accelerator means (not shown). The valve 22 may be coupled to a lost motion mechanism (not shown), as described in the applicant's U.S. Pat. No. 5,251,597 which is incorporated herein by reference, so as to provide a desired air flow to the engine cylinders. As is known in the art, the value 22 typically comprises feedback means which provide a signal to an electronic engine management system (not shown) indicated the operating angle thereof. The air induction system 20 delivers the controlled rate of air to a crankcase 23 of the respective cylinders in the conventional manner as is known in two stroke cycle engines.

The cylinder head 24 of the two cylinders is of a unitary construction presenting a co-planar upper surface in which there are provided respective apertures to receive independent fuel injection units 25. Spanning the cylinder head 24 is a common air/fuel rail 26 which is clamped to the cylinder head 24 by a series of bolts so as to complete the securement of the injection units 25 and air/fuel rail 26 to the engine cylinder head 24.

The rail 26 has two longitudinal passages provided therein (not shown), one of which carries fuel to each of the injection units 25, and the other which carries compressed air to each of the injection units 25, and the other which FIG. 1, the fuel passage in the rail 26 is in the upper area thereof and is in communication with the fuel tank 13 via the conduits 28 and 29, the fuel pump 30 and a fuel filter 31. The air passage in the rail 26 which is in the lower area thereof is in communication with the delivery side of a compressor 32 by way of the conduit 33 which is connected to an outlet port 43 of the compressor 32 located in the upper region thereof.

The rail 26 has a fuel pressure regulator 36 communicating with the fuel passage within the rail 26 to maintain the required fuel pressure for delivery to the injection units 25. The regulator 36 is connected via a return duct 35 to the fuel tank 13. Similarly, the air passage in the rail 26 communicates with an air pressure regulator 38 to control the pressure of the air delivered to the injection units 25. When necessary, excess air is discharged to or recirculated to the air induction system 20 under the control of the air regulator 38 via the conduit 42. Further, as can be seen in FIG. 2, an angling means 27 is provided on the air induction system 20 so as to slightly angle the air induction system 20 from the position it would otherwise assume if the angling means 27 was not used. Hence, in this way, the air induction system 20 is caused to be located slightly further rightward from the engine 15 and hence cylinder head 24. This enables appropriate location of the air and fuel rail 26 with the regulators 36 and 38 mounted thereon such that spark plugs 39 are able to be mounted on the exhaust side of the cylinder head 24. In this connection, different configurations or arrangements of combustion chambers within the engine cylinders may require the location of the centrally mounted fuel injection units 25 to be varied slightly and hence a corresponding necessary movement or position adjustment of the air and fuel rail 26 is able to be accommodated by a slight angling of the air induction system 20, or alternatively, as previously indicated, the exhaust system 40.

As can be seen in FIG. 1, the conduits 28 and 29 are, taking into account the mounting location of the fuel pump 30, maintained as short as possible to reduce the time required to prime these conduits 28 and 29 upon first operation of the fuel pump 30. Further, it is evident that the location of the fuel pump 30 to correspond with a fuel inlet 31 of the air and fuel rail 26 greatly reduces the length of the conduits 28 and 29. Hence, the overall packaging and cost attributable to the fuel system is maintained at a simple and cost effective level.

Similarly, fuel lines which provide for a reserve supply of fuel as are common on such personal watercraft may also be reduced to a minimum length to optimise the priming time when operating from reserve fuel. In this regard, an appropriate switch valve to change from the normal fuel supply to a reserve fuel supply as is known in the field may conveniently be appropriately located at that end of the hull 10 corresponding to the location of the fuel tank 13.

A respective spark plug 39 for each cylinder is provided at a location between the air and fuel rail 26 and the engine exhaust system 40. It has been found that the stability of the engine operation is significantly enhanced when the spark plugs 39 are in communication with the engine 15 towards the exhaust port side of the respective cylinders rather than adjacent the intake side of the engine 15.

As can be seen, particularly in FIG. 2 of the drawings, the above described relative relationship of the fuel injection units 25, combined air and fuel rail 26, spark plugs 39 and fuel and air pressure regulators 36 and 38 can be conveniently located between the air induction system 20 on one side of the cylinder head assembly and the exhaust system 40 on the opposite side of the cylinder head assembly. This form of installation of a fuel injection system will substantially enhance the power output of the engine 15 and reduce the level of harmful exhaust emissions without adding to the volume of the hull cavity 11 occupied by the engine 15 and its accessories. Essentially, optimum use is made of the valley existing between the air induction system 20 and exhaust system 40 by accommodating the air/fuel rail 26 therein.

It will be further noted, particularly from FIG. 2, that the air compressor 32 supplying the compressed air to the rail 26 and hence to the injection units 25, is conveniently located below the rear portion of the exhaust system 40 and thus, again does not add to the overall area occupied by the engine 15. In particular, it can be seen that the outermost edge of the compressor 32 lies within the outermost edge of the exhaust system 40 and so does not contribute to an increase in the width of the engine 15. As seen in FIG. 2, the compressor 32 is driven by a belt 45 coupled to the pulley 46 mounted on the engine drive shaft 47. The tension of the belt 45 is arranged to be adjustable by way of the locking means 48 which is arranged to co-operate with the arc-shaped aperture 49. That is, depending upon the position of the locking means 48 with respect to the aperture 49, the compressor 32 is caused to pivot about an upper pivot point (not shown) located opposite to the aperture 49 to either increase or decrease the tension on the belt 45.

Further, it is evident that the mounting of the compressor 32 at that end of the engine 15 that corresponds to the air inlet 41 of the rail 26 contributes to providing a minimum length for the conduit 33. Hence, the air volume downstream of the compressor outlet port 43 is equally kept to a minimum volume resulting in a short "pump-up" or pressurisation time for the rail 26 being necessary upon start of engine operation.

It is to be understood that the general arrangement of the components is applicable to engines of single cylinder or even of V multi-cylinder form.

Figure 3:
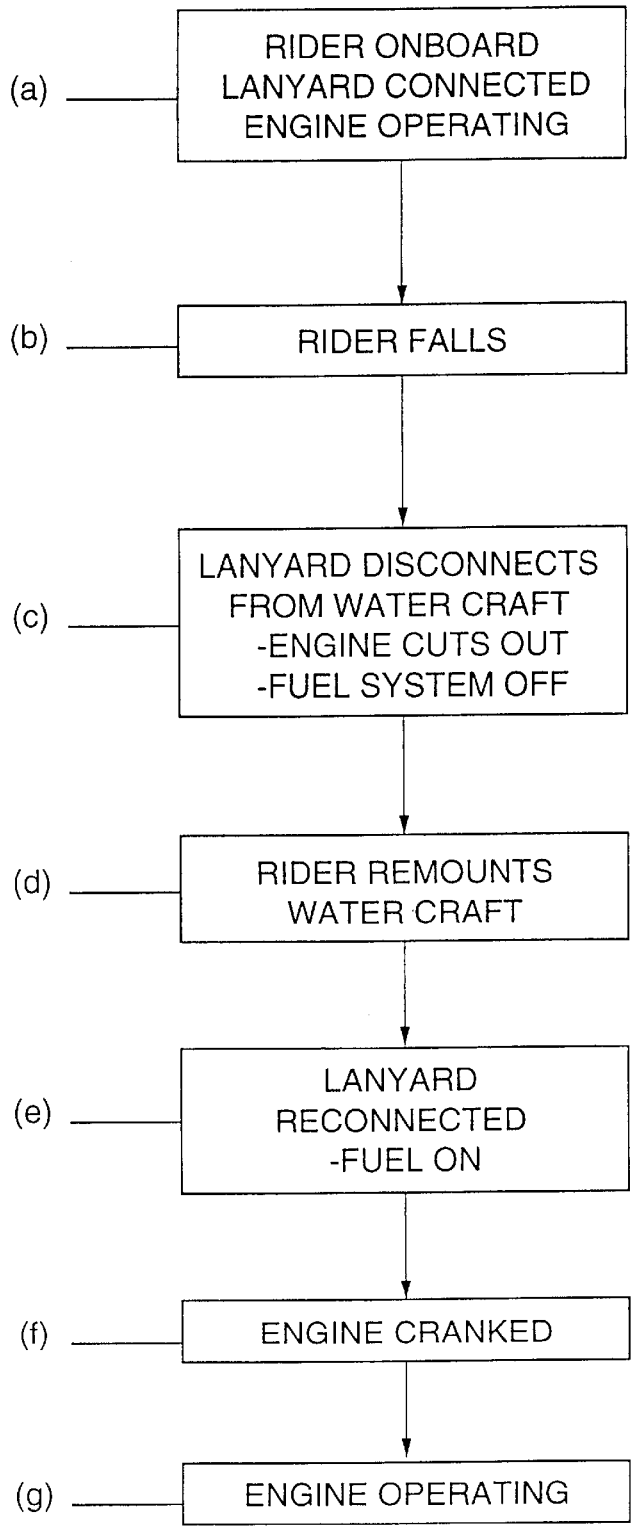
FIG. 3 is a diagrammatic representation of the events sequence in relation to engine start-up.

FIG. 3 shows in a diagrammatic form the sequence of steps in the operation of a typical cut-out installation on a water vehicle. This layout may of course be applied to other engines or engine propelled vehicles. The sequence may be described as follows:

(a) the normal operating condition wherein the rider is on board the vehicle with the engine operating in its normal manner and the circuit breaker is in position forming an operative circuit between an electrical storage battery and the vehicle engine;

(b) the rider has fallen off the water vehicle or has been separated from the appropriate vehicle which gives rise to condition (c);

(c) the lanyard which is connected to the driver of the vehicle disconnects from the vehicle, thereby opening the cut out in electrical circuit between the battery and the engine and immediately cuts off the electrical energy to the fuel supply system and ignition system to thereby stop the vehicle;

(d) the driver has returned to and taken a position in or on the vehicle;

(e) the driver has re-inserted the cut out element attached to the lanyard into the electrical circuit so that the electrical energy is available to operate the engine and at the same time, energising the fuel pump to provide fuel to the engine to promote rapid start-up;

(f) the engine start-up procedure is initiated normally, such as by a manually operated switch, so that a starter motor cranks the engine to establish operation thereof;

(g) the engine fires and commences to operate in the conventional manner with electrical energy being supplied from the battery to provide the necessary spark for ignition of the combustible mixture, and to provide the supply of fuel from the fuel tank to the engine.

It will be appreciated that the termination of operation of the engine as referred to in reference to FIG. 3 can be in response to other interactions between the driver and the vehicle apart from, or alternative to the use of the lanyard attached to the driver as above discussed. For example, termination of operation of the engine may be simply the switching off of the engine by the operator.

Other modifications may be apparent to those skilled in the art and fall within the scope of the present invention.

The claims defining the invention are as follows:

1. An in-line multi-cylinder internal combustion engine for use in a personal vehicle or watercraft, said engine having a length along a cylinder block of said engine, comprising:

a cylinder head attached to the cylinder block;

an air induction system and a combustion gas exhaust system, each extending along a longitudinal axis generally in a direction along said length along the cylinder block, and both said systems having an outer extremity at least a portion of which extends upwardly beyond said cylinder head so as to define an external limit of said engine;

a fuel rail extending longitudinally along said length along the cylinder block parallel with the longitudinal axes of said air induction system and said combustion gas exhaust system and mounted on the cylinder head between said air induction system and said combustion gas exhaust system, said fuel rail overlying and being in fuel transfer communication with respective fuel injector units located in the cylinder head, and each said fuel injector unit communicating with a respective cylinder of the engine, said fuel rail having an outermost portion retained internal to the external limit of the engine.

2. An engine as claimed in claim 1, wherein said air induction system and said combustion gas exhaust system each have a longitudinal axis and the longitudinal axes define a horizontal plane, and wherein said fuel rail lies in said plane.

3. An engine as claimed in claim 2, wherein said plane is positioned entirely above said cylinder head.

4. In an internal combustion engine for use in a personal vehicle or watercraft and having a direct injected fuel system, an improvement comprising the selection of an engine configuration whereby an air induction system and a combustion gas exhaust system each extending along a longitudinal axis generally in a direction along a length of a cylinder block of said engine, both said air induction system and said combustion gas exhaust system having an outer extremity at least a portion of which extends upwardly beyond a cylinder head of said engine block thereby defining an external limit of said engine such that an outer extremity of a fuel rail for said directed injected fuel system located on said head is retained internal to said external limit of said engine, said fuel rail extending longitudinally along the length of the cylinder block parallel with the longitudinal axes of said air induction system and said combustion gas exhaust system.

5. The improvement as claimed in claim 4 wherein one or more spark plugs are mounted in the cylinder head, at least one for each cylinder of the engine, said spark plugs being located between the exhaust system side of the engine and the fuel rail.

6. The improvement as claimed in claim 4, wherein the fuel rail includes respective fuel and gas passages therein for the delivery of fuel and a gas independently to each fuel injector.

7. The improvement as claimed in claim 6, wherein the fuel rail is arranged to receive fuel proximate one end of said fuel rail and to receive gas proximate another end of said fuel rail.

8. The improvement as claimed in claim 7, wherein a fuel pump is located adjacent an end of the fuel rail where the fuel is delivered thereto.

9. The improvement as claimed in claim 6, wherein a compressor is provided in communication with the gas passage in the fuel rail.

10. The improvement as claimed in claim 9 wherein the compressor is drive coupled to the engine to be driven thereby.

11. The improvement as claimed in claim 10, wherein said compressor is drive coupled to a drive shaft located at one end of the engine.

12. The improvement as claimed in claim 10, wherein said compressor is drive coupled to a balance shaft of the engine.

13. The improvement as claimed in claim 10, wherein the compressor is located to one side of the cylinder block and beneath the combustion gas exhaust system.

14. The improvement as claimed in claim 4, wherein the air induction system is a single duct supplying air for all cylinders and has a single air flow control means to regulate the air flow rate to the engine.

15. The improvement as claimed in claim 7, wherein a fuel tank is located adjacent the end of the fuel rail to which the fuel is delivered to fuel passage in the rail.

16. The improvement as claimed in claim 15, wherein a fuel pump is disposed within the fuel tank and the pump is arranged to deliver fuel to the fuel passage of the fuel rail.

17. The improvement as claimed in claim 4, in combination with a vehicle having an electric operated fuel supply system to deliver fuel to said fuel rail, and means operable to activate said fuel system in response to a driver initiated act independent of cranking of the engine.

18. The improvement as claimed in claim 4, wherein said direct injection fuel system is a dual fluid system having a compressor, said compressor being located internal to a further extremity of the engine defined by said combustion gas exhaust system whereby the outer limits of the engine are retained.

19. The improvement as claimed in claim 4, wherein said air induction system and said combustion gas exhaust system each have a longitudinal axis and the longitudinal axes define a horizontal plane, and wherein said fuel rail lies in said plane.

20. The improvement as claimed in claim 19, wherein said plane is positioned entirely above said cylinder head.

21. An engine as claimed in claim 1 wherein one or more spark plugs are mounted in the cylinder head, at least one for each cylinder of the engine, said spark plugs being located between the exhaust system side of the engine and the fuel rail.

22. An engine as claimed in claim 1, wherein the fuel rail includes respective fuel and gas passages therein for the delivery of fuel and a gas independently to each fuel injector.

23. An engine as claimed in claim 22 wherein the fuel rail is arranged to receive fuel proximate one end of said fuel rail and to receive gas proximate another end of said fuel rail.

24. An engine as claimed in claim 23 wherein a fuel pump is located adjacent an end of the fuel rail where the fuel is delivered thereto.

25. An engine as claimed in claim 21 wherein a compressor is provided in communication with the gas passage in the fuel rail.

26. An engine as claimed in claim 25 wherein the compressor is drive coupled to the engine to be driven thereby.

27. An engine as claimed in claim 26 wherein said compressor is drive coupled to a drive shaft located at one end of the engine.

28. An engine as claimed in claim 26 wherein said compressor is drive coupled to a balance shaft of the engine.

29. An engine as claimed in claim 26, wherein the compressor is located to one side of the cylinder block and beneath the combustion gas exhaust system.

30. An engine as claimed in claim 19 where the air induction system is a single duct supplying air for all cylinders and has a single air flow control means to regulate the air flow rate to the engine.

31. An engine as claimed in claim 23 wherein a fuel tank is located adjacent the end of the fuel rail to which the fuel is delivered to fuel passage in the rail.

32. An engine as claimed in claim 31 wherein a fuel pump is disposed within the fuel tank and the pump is arranged to deliver fuel to the fuel passage of the fuel rail.

33. An engine as claimed in claim 1 in combination with a vehicle having an electric operated fuel supply to deliver fuel to said fuel rail, and means operable to activate said fuel system in response to a driver initiated act independent of cranking of the engine.

34. A personal vehicle or watercraft propelled by an internal combustion engine and having an electrically operated fuel supply system to supply fuel for the engine, including means for activating said fuel supply system, prior to engine start up, in response to a driver initiated act independent of cranking of the engine, said engine comprising:

a cylinder block having a length;

a cylinder head attached to the cylinder block;

an air induction system and a combustion gas exhaust system, each extending along a longitudinal axis generally in a direction along said length along the cylinder block, and both of said systems having an outer extremity at least a portion of which extends upwardly beyond said cylinder head so as to define an external limit of said engine;

a fuel rail extending longitudinally along said length along the cylinder block parallel with the longitudinal axes of said air induction system and said combustion gas exhaust system and mounted on the cylinder head between said air induction system and said combustion gas exhaust system, said fuel rail overlying and being in fuel transfer communication with respective fuel injector units located in the cylinder head, said fuel rail having an outermost portion retained internal to the external limit of said engine, and each said fuel injector unit communicating with a respective cylinder of the engine.

35. A vehicle as claimed in claim 34 wherein said means for activating the fuel system is operable in response to the driver occupying a selected location in or on the vehicle.

36. A vehicle as claimed in claim 34 wherein said means for activating the fuel includes an electrical circuit having a removable circuit cut-out element therein, said circuit cut-out element being attachable to a vehicle operator and selectively insertable and removable from the electric circuit by the operator.

37. A vehicle as claimed in claim 36 wherein said removable element is attached to the vehicle operator by a lanyard, and thus is removed from the vehicle when the vehicle operator is separated from the vehicle.

* * * * *